US005381130A

United States Patent [19]

Thuillard et al.

[11] Patent Number: 5,381,130

[45] Date of Patent: Jan. 10, 1995

[54] OPTICAL SMOKE DETECTOR WITH ACTIVE SELF-MONITORING

[75] Inventors: Marc Thuillard, Mannedorf; Andreas Scheidweiler, Maseltrangen; Kurt Hess, Wolfhausen, all of Switzerland

[73] Assignee: Cerberus AG, Männedorf, Switzerland

[21] Appl. No.: 942,141

[22] Filed: Sep. 8, 1992

[30] Foreign Application Priority Data

Sep. 6, 1991 [CH] Switzerland ..... 2626/91

[51] Int. Cl.[6] ..... G08B 17/10

[52] U.S. Cl. ..... 340/630; 340/628; 250/575; 356/438

[58] Field of Search ..... 340/628, 629, 630; 356/438; 250/524, 575

[56] References Cited

U.S. PATENT DOCUMENTS 4,166,960 9/1979 Meili ..... 250/574
5,008,559 4/1991 Beyersdorf ..... 250/575

FOREIGN PATENT DOCUMENTS 0076338 4/1983 European Pat. Off. .
0360126 3/1990 European Pat. Off. .
2754139 4/1987 Germany .
131052 7/1974 Japan .
590527 8/1977 Switzerland .

*Primary Examiner*—Jeffery A. Hofsass
*Attorney, Agent, or Firm*—Brumbaugh, Graves, Donohue & Raymond

[57] ABSTRACT

In a scattered-light smoke detector, for preventing false alarms due to extraneous matter in a measurement chamber (1), a radiation source (2) and two radiation detectors (7, 8) are included. An evaluation circuit is provided for comparing the two detector signals, and an alarm signal is triggered if at least one of the detector signals exceeds a predetermined threshold, and if the two detector signals are at least approximately equal. In another embodiment, a scattered-light smoke detector includes two radiation sources (2, 22), a radiation detector (7), and circuitry for alternatively activating one (2) or the other (22) radiation source. For comparison, corresponding detector signals are stored in sample-and-hold circuits, and an alarm signal can be triggered depending on the same tests. Furthermore, in both cases, a trouble signal can be produced if the two signals are significantly different.

12 Claims, 6 Drawing Sheets

OPTICAL SMOKE DETECTOR WITH ACTIVE SELF-MONITORING

BACKGROUND OF THE INVENTION

The invention relates to optical smoke detectors for use, e.g., in early-warning automatic fire alarm systems.

Smoke detectors are distinguished among automatic fire detectors; on account of their exemplary ability to detect fires at a stage sufficiently early for timely deployment of countermeasures. Two types of smoke detectors are particularly important, namely ionization smoke detectors and optical smoke detectors. For smoke detection, the former depend on detecting adsorption of smoke particles on atmospheric ions, and the latter on optical effects in aerosols, e.g., the extinction of a beam of light by smoke ("extinction detectors") or the scattering of light by smoke particles ("scattered-light smoke detectors"). Since extinction by smoke particles is relatively weak, a relatively long measurement distance is required for reliable smoke detection by extinction detectors. This does not apply to the more widely used scattered-light smoke detectors, in which the measurement distance may be so short as to permit the design of so-called "point detectors".

The present invention more particularly relates to scattered-light smoke detectors. As an important design precaution, a scattered-light radiation detector must be prevented from responding to radiation not due to scattering by smoke particles. For example, in order to prevent ambient radiation from reaching the radiation detector, such a detector is provided with a light-shielding enclosure surrounding the optical beam in the measurement chamber. Smoke-inlet openings in the enclosure permit entry of ambient air, while substantially preventing the admission of light.

It is a precondition for reliable operation of a scattered-light smoke detector that no spurious light fall on the detector as reflected from the surfaces which delimit the measurement volume, or from extraneous matter deposited thereon. Designs have been proposed for minimizing the influence of surface reflections. Mainly, such proposals concern the design of optical labyrinths which largely absorb incident light; see, e.g., Swiss Patent Document CH-A5-590527.

Since smoke inlet openings cannot be made arbitrarily small, it is impossible to prevent admission of dust, fibers, or insects into the smoke detector, which may cause malfunctioning. Irradiated extraneous matter acts as a source of spurious light, and, if such light reaches the radiation detector, an electrical output signal may be produced as if smoke were present. As a result, in the interest of preventing frequent false alarms, scattered-light smoke detectors require regular cleaning, which may entail considerable costs.

Another, particularly vexing cause of false alarms arises with condensation of humidity on the measurement chamber surfaces, caused by temperature changes, and typically being of limited duration. This also produces spurious reflections which may be sensed by the radiation detector. Even cleaned detectors can be subject to this effect, so that servicing of detectors is of no avail in such cases.

This problem was addressed by methods which monitor the increase in surface reflections and which produce a trouble signal when secondary light from surface deposits exceeds a threshold level. Such methods fail, however, when deposition over time produces a signal which is similar to that due to a developing fire.

In order to overcome this drawback, two radiation detectors were included in a known smoke detector (see Japanese Patent Document JP-UM-131052), having fields of view encompassing different parts of a beam which lie at different distances from the radiation source and in which the radiation intensity differs in the presence of smoke. A logic circuit is included to ensure that an alarm is triggered only if the detected radiation intensities are in proper ratio. Since the fields of view of the two receivers encompass different surface portions, different reflection properties at such portions are unavoidable, as may be due to different degrees of dust deposition.

For the elimination of the influence of surface reflections, German Patent Document DE-C3-2754139 proposes a scattered-light smoke detector (see FIG. 1 of the present Drawing) in which a radiation source 2 disposed in a cylindrical enclosure 1 emits a beam of radiation across the measurement chamber. At another location of the cylinder surface, and away from the optical beam 3, a first radiation detector 7 is disposed such that its field of view 13 intercepts the optical beam 3 approximately at its midpoint and encompasses at least a portion of the optical beam 3. A second radiation detector 8 is disposed in the vicinity of the radiation detector 7, with a field of view 14 not touching the optical beam 3 but passing outside its perimeter, and directed to the same surface area 15 which is encompassed by the field of view 13 of the first radiation detector 7. By means of an evaluation circuit including a difference-forming element for forming the difference between the signals of the two radiation detectors 7 and 8, it is possible, under certain circumstances, to eliminate the influence of the spurious radiation from the surface area 15. In practice, however, it is impossible to adjust the fields of view of the radiation detectors 7 and 8 with sufficient accuracy for exact matching of the surface portions covered and for matching of the reflections. As a result, the problem of false alarms remains unsolved.

The main drawback of the known methods for the prevention of false alarms due to contamination lies with unrealistic demands on the optical systems, radiation sources and radiation detectors. In the presence of extraneous matter on lenses and diaphragms, their assigned tasks are impossible to fulfill as radiation paths fail expectations.

In view of the state of the art as described above, the invention is aimed at providing a scattered-light smoke detector which is not subject to the limitations of known scattered-light detectors. More particularly, the invention is aimed at providing a scattered-light smoke detector in which scattered light due to extraneous deposits is unambiguously recognized as such, so that false alarms due to contamination are prevented.

SUMMARY OF THE INVENTION

The invention is predicated on the discovery that, in contrast to spatially essentially homogeneous radiation scattered by smoke particles in a measurement volume, radiation scattered by measurement-chamber contamination is spatially non-homogeneous. Thus, sensing of non-homogeneity can be used as a diagnostic tool for the presence of contamination.

In a preferred technique in accordance with the invention, a radiation source and a plurality of radiation detectors are disposed in a measurement chamber, the radiation detectors being separated such that light from extraneous matter travels different distances or such that the fields of view of the radiation detectors are sufficiently separated. In either case, the output signals from the radiation detectors are different. Instead of several radiation detectors, a single radiation detector can be used having a segmented detector surface (e.g., halved or divided in four).

In a preferred further technique in accordance with the invention, a plurality of radiation sources and a radiation detector are disposed in the measurement chamber, the radiation sources are operated in alternating fashion, and the output signals of the radiation detector are stored for later evaluation. Either the radiation sources are separated such that light incident on the deposited extraneous matter travels different distances, or their intensity distributions are sufficiently different from each other. In either case, the light scattered by extraneous deposits can be distinguished from light scattered by smoke particles, and the corresponding output signals of the radiation detector are also distinguishable.

In an exemplary case, with two radiation detectors, the electrical signals increase regularly due to the homogeneous distribution of the smoke particles, whereas the presence of extraneous matter causes different increases in the two radiation detectors. In this case, to detect the origin of the radiation, it suffices to form the difference of the electrical output signals of the two radiation detectors.

DETAILED DESCRIPTION OF PREFERRED EMBODIMENTS

Preferred embodiments of the invention are predicated on the following observations and will be described with reference to FIGS. 2–12, 5*a* and 5*b*.

In a search for characterizing scattering differences between dust particles and smoke, experiments were carried out with scattered-light smoke detectors which had been exposed to a dusty atmosphere. It was discovered that, at least in an initial stage of contamination by dust or condensation of humidity inside a smoke detector, the distribution of extraneous matter on measurement-chamber surfaces is quite non-homogeneous, whereas the distribution of smoke in the measurement chamber is essentially homogeneous. Moreover, there are significant differences between smoke and dust particles with respect to their size and numbers. While smoke represents a homogenous distribution of a large number of very small particles, dust deposits and condensation represent a non-homogeneous distribution of a small number of relatively large particles, at least in an initial phase. A few dust particles are sufficient to produce scattered light as if by a large number of smoke particles, and to trigger a false alarm.

Figure 1:
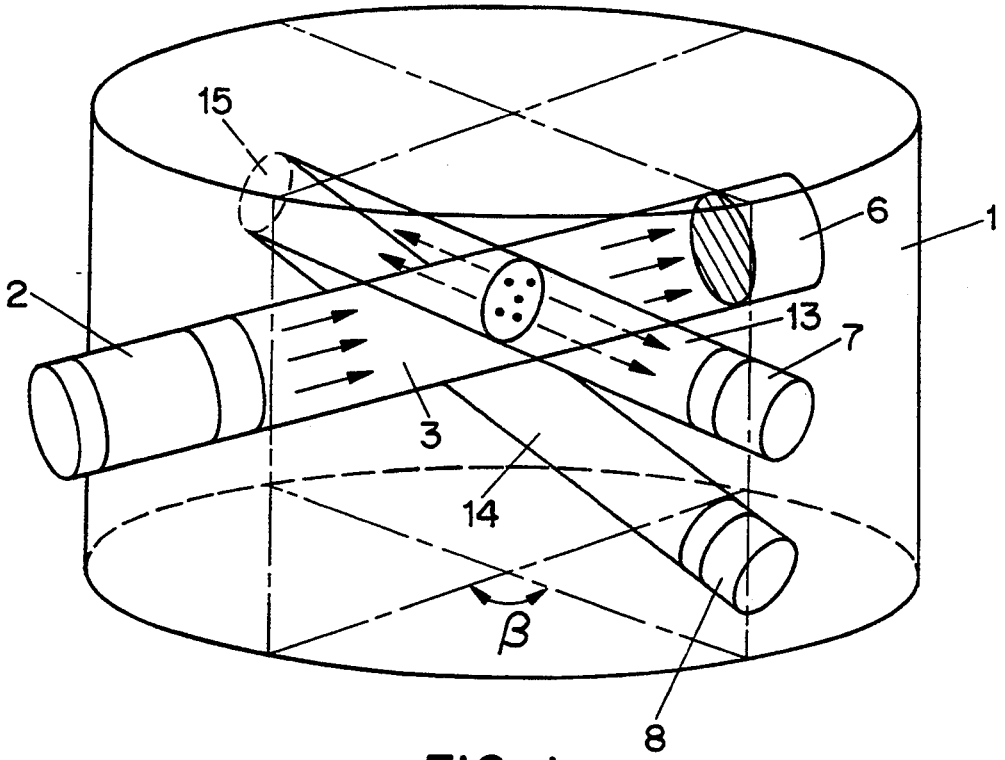
FIG. 1 PRIOR ART
FIG. 1 is a perspective representation of a prior-art scattered-light smoke detector.
Figure 2:
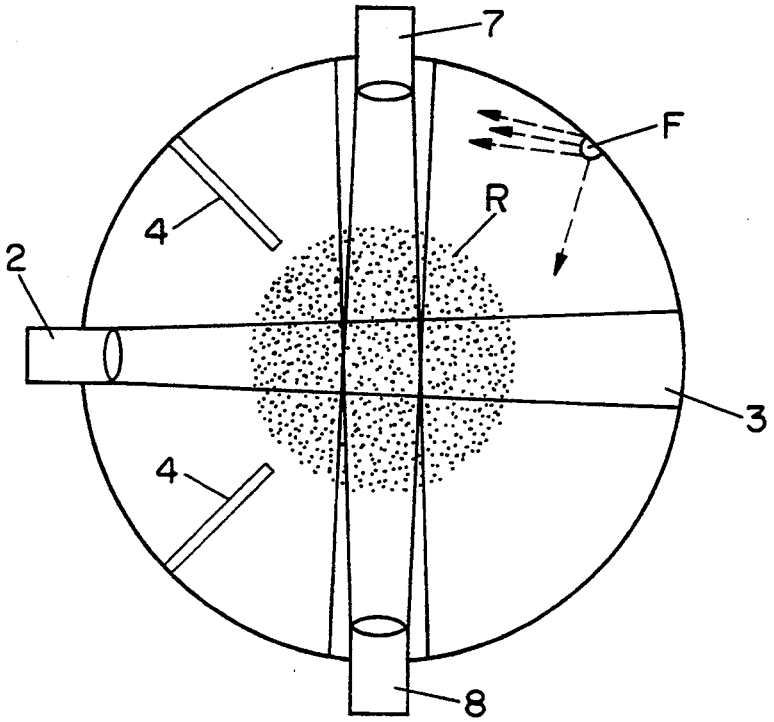
FIG. 2 is a schematic cross section of a preferred first embodiment of a scattered-light smoke detector in accordance with the invention, including a radiation source and two radiation detectors remote from each other.
Figure 3:
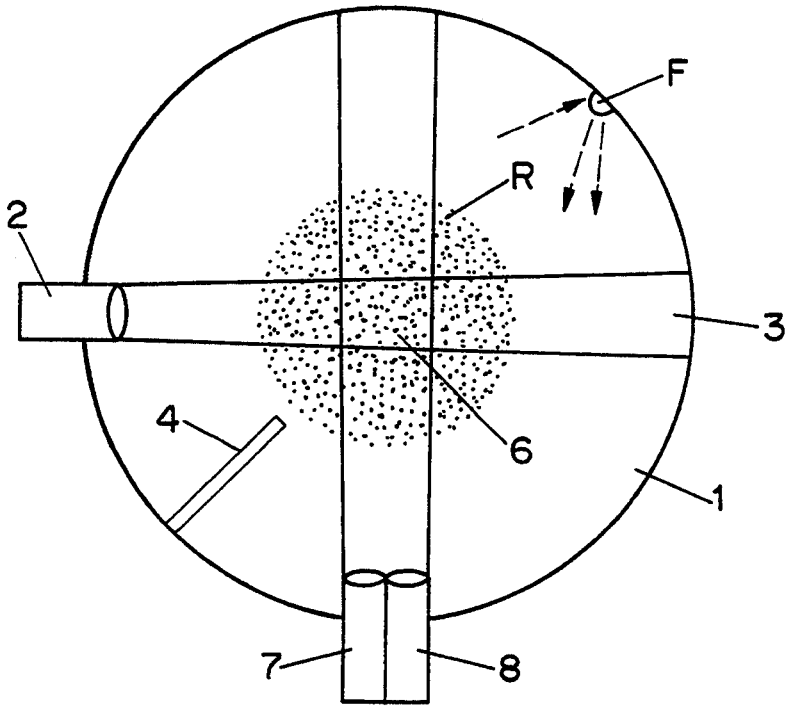
FIG. 3 is a schematic cross section of a preferred second embodiment of a scattered-light smoke detector in accordance with the invention, including a radiation source and two radiation detectors having different fields of view.

FIG. 2 shows a measurement chamber 1 which is optically insulated from the ambient atmosphere, a radiation source 2, and mutually remote radiation detectors 7 and 8 disposed such that no direct radiation from the radiation source 2 can reach the radiation detectors 7 and 8, e.g., due to a suitably arranged system 4 of diaphragms. The measurement chamber 1 is connected with the ambient atmosphere via smoke inlet openings (not shown). Further shown are a small, representative number of smoke particles R and extraneous surface matter F.

For extraneous surface matter F as well as for smoke particles R, the intensity of scattered light is proportional to light intensity at the point of incidence. However, there is a key difference between light scattered by extraneous surface matter F and by a smoke particle R, as smoke is distributed essentially uniformly or homogeneously in the measurement chamber 1, whereas extraneous matter F is located irregularly or non-homogeneously in the measurement chamber 1. The intensity of scattered light from extraneous matter F is proportional to incident light intensity at the site of the extraneous matter F; the intensity of scattered light from smoke particles R is proportional to incident light intensity over the entire measurement volume.

Based on experiments with smoke detectors after prolonged use, it has been established that extraneous matter F (e.g., dust) contaminating the measurement volume 1 is quite unevenly distributed. As a result, light scattered by the extraneous matter F is non-homogeneous, and the scattered light reaching the detector 7 depends strongly on the location of the extraneous matter F. Depending on the location of the extraneous matter F, scattered light travels paths of different lengths. Smoke-particle scattering centers, on the other hand, are essentially uniformly distributed in the measurement chamber 1. Scattered light reaching the detector 7 from the particles R depends only on their concentration and their optical properties.

This distinction motivates the inclusion, in smoke detectors preferred in accordance with the invention, of a plurality of radiation detectors (7 and 8 in FIGS. 2 and 3) or of a plurality of light sources (2 and 22 in FIGS. 4 and 5) which are disposed such that, upon comparison of light-detector output signals, scattering by smoke particles R can be distinguished from scattering by extraneous matter F.

If two spatially separated radiation sources 7 and 8 are included (see FIG. 2), the signals can be compared directly. This is further illustrated by Example 1 below.

Figure 4:
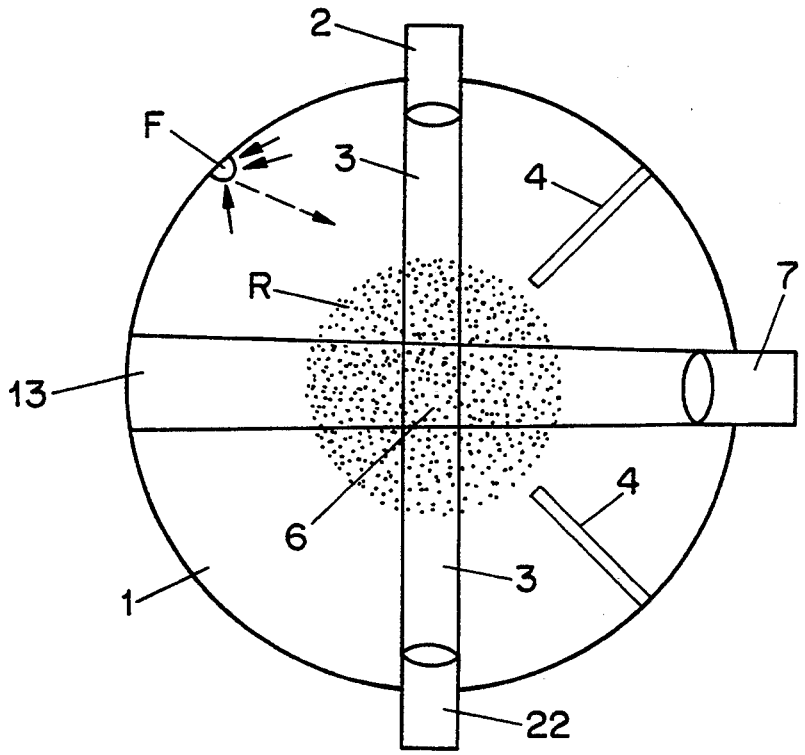
FIG. 4 is a schematic cross section of a preferred third embodiment of a scattered-light smoke detector in accordance with the invention, including a radiation detector and two radiation sources remote from each other.
Figure 8:
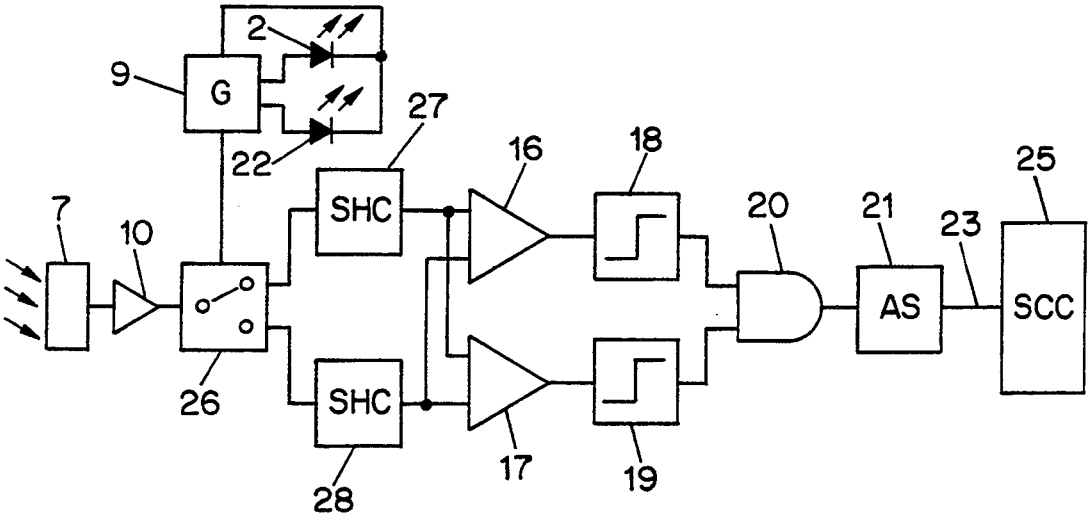
FIG. 8 is a block diagram of an exemplary electronic circuit of a scattered-light smoke detector in accordance with FIG. 4.

If, as shown in FIG. 4, two radiation sources 2 and 22 are included with a single radiation detector 7, the two radiation sources 2 and 22 are operated in alternating fashion, with storing of the output signals of the radiation detector 7, so that the two output signals can be evaluated by separate evaluation stages or channels (see FIG. 8). This is further illustrated by Example 2 below.

In the embodiment shown in FIG. 5 and further exemplified by Example 3 below, two light sources 2 and 22 with different intensity profiles are disposed closely adjacent. By this arrangement it becomes possible to determine whether the signal received by the radiation detector 7 is proportional to the combined intensities of the radiation sources 2 and 22, i.e., whether the detected signal is caused by smoke R as contrasted with extraneous matter F. Idealized, the following relationship holds for scattered light due to smoke:

$$U1/U2 = \int I1(x,y,z)dxdydz / \int I2(x,y,z)\,dxdydz$$

where I1(x,y,z) denotes the intensity of scattered light at a point (x,y,z) in the measurement volume when light is emitted by the radiation source 2, and U1 the corresponding radiation-detector output signal; I2(x,y,z) denotes the intensity of scattered light at a point (x,y,z) in the measurement volume when light is emitted by the radiation source 22, and U2 the corresponding radiation-detector output signal; and the integrations are over the measurement volume.

Figure 12:
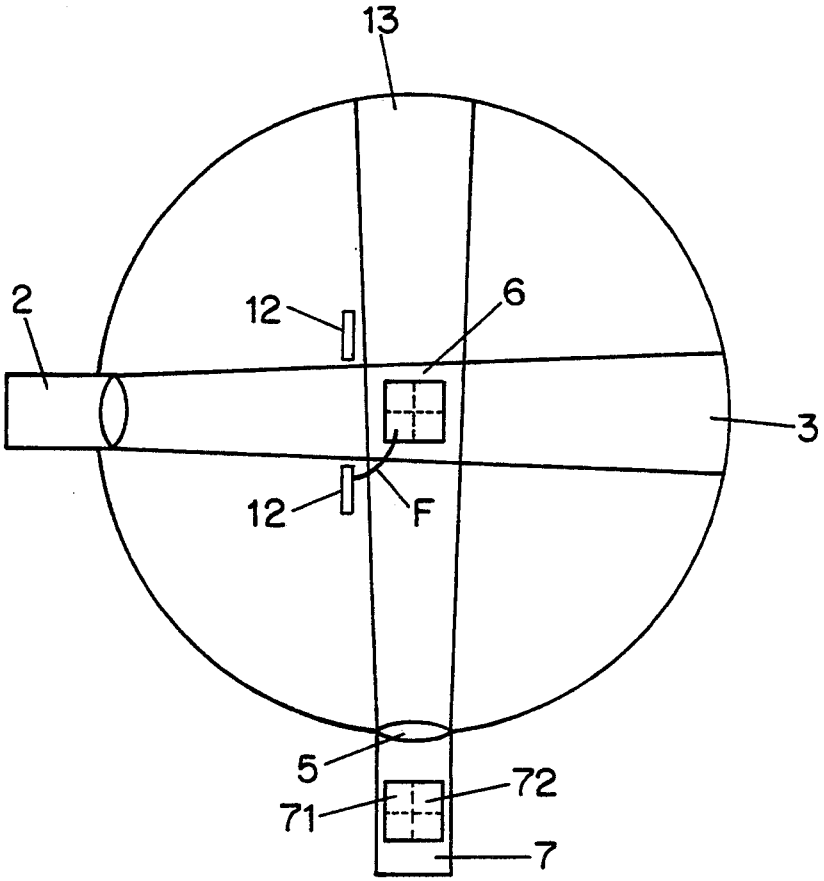
FIG. 12 is a schematic cross section of a preferred fifth embodiment of a scattered-light smoke detector in accordance with the invention, including a segmented radiation detector.

In an alternative embodiment, instead of using two radiation detectors 7 and 8, a single radiation detector 7 may be used having a detector surface which is divided into two detector portions (detector halves) 71 and 72; see FIG. 12. The optical beam 3 from the radiation source 2 intersects the field of view 13 of the radiation detector 7; this intersection defines the measurement volume 6. An optical element such as a lens 5 is disposed in front of the radiation detector 7 such that the measurement volume 6 is imaged onto the surface of the radiation detector 7. The partitioning of detector 7 into halves may be horizontal or vertical. A fiber F on the central diaphragm 12 affects the detector portions 71 and 72 differently. The fiber F can be distinguished from smoke by measurement of the degree of symmetry of the output signals from the two detector halves.

If the two detector halves 71 and 72 are disposed one (72) above the other (71), the field of view of the lower detector half 71 lies above the field of view of the upper detector half 72. Dust entering the measurement chamber is deposited primarily in the lower part of the measurement chamber, so that dust is detected primarily by the upper detector half. A determination of the degree of symmetry can be used to distinguish between dust and smoke.

In a preferred embodiment of the smoke detector described above, with a subdivided radiation detector 7, the radiation detector 7 is subdivided into four detector portions. This is particularly advantageous for detecting changes in the radiation symmetry. In normal operation, the radiation-detector portions are connected in parallel. As soon as a predetermined signal threshold (pre-alarm threshold) is exceeded, the radiation-detector portions are interrogated individually.

In the absence of spurious surface reflections, the output signals of the individual radiation-detector elements increase equally upon entry of smoke into the measurement chamber, whereas these signals are significantly different in the case of contamination by dust. In consequence, the presence of extraneous matter F (fibers, insects, dust deposits or condensates) can be readily detected upon comparison of the output signals of the radiation detectors or detector portions. In the simplest case, it suffices to form the difference of signals to determine the nature of the signals.

EXAMPLE 1

Figure 6:
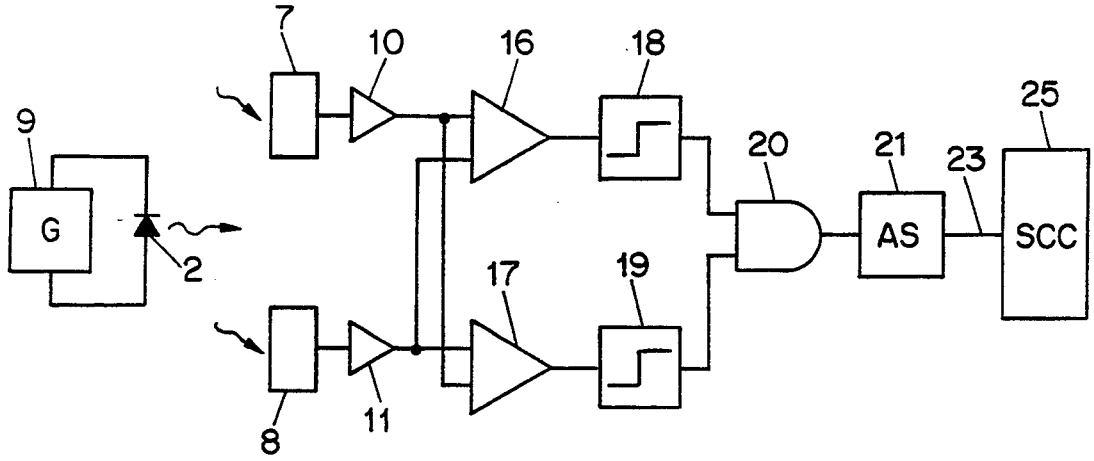
FIG. 6 is a block diagram of an exemplary electronic circuit of a scattered-light smoke detector in accordance with FIG. 2.

The smoke detector described above with reference to FIG. 2 is combined with an electronic control circuit as shown in FIG. 6. In operation, the radiation source 2 is periodically activated by the generator 9, sending light pulses into the measurement chamber 1. The electrical output signals of the radiation detectors 7 and 8 are amplified in separate amplifiers 10 and 11 and fed separately to two operational amplifiers 16 and 17.

When smoke enters the measurement chamber 1, the two radiation detectors 7 and 8 are exposed to approximately the same amount of radiation, so that their output signals are approximately equal. If extraneous matter F has become attached to the surface of the measurement chamber 1, different radiation-path lengths between the extraneous matter F and the radiation detectors 7 and 8 result in the radiation detectors 7 and 8 receiving different amounts of spurious light, and the electrical output signals of the amplifiers 10 and 11 are different.

The first operational amplifier 16 is designed such that its output signal is proportional to the average of the two output signals of the amplifiers 10 and 11. The second operational amplifier 17 is designed such that its output signal is proportional to the absolute value of the relative difference of the output signals of the amplifiers 10 and 11, representing a measure for the degree of asymmetry of the scattering sites F relative to the two radiation detectors 7 and 8. When smoke enters the measurement chamber 1, the output signal of the second operational amplifier 17 is small; when extraneous matter (fibers, insects, dust) has entered, this signal is large.

The output terminals of the two operational amplifiers 16 and 17 are connected to two threshold gates 18 and 19 which produce an output signal whenever the output signals of the corresponding operational amplifiers 16 and 17 exceed a predetermined threshold. Thus, the first threshold gate 18 produces an output signal when the average value of the output signals of the two amplifiers 10 and 11 (i.e., the output signal of the first operational amplifier 16) exceeds a first predetermined value, and the second threshold gate 19 produces an output signal when the absolute value of the relative difference of the output signals of the two amplifiers 10 and 11 (i.e., the output signal of the second operational amplifier 19) exceeds a second predetermined value.

The output terminals of the threshold gates 18 and 19 are connected to a logic circuit 20 whose output signal activates an alarm stage 21 for producing an alarm signal. The alarm stage 21 is connected via a first signalling line 23 to a signalling and control center 25.

The logic circuit 20 is designed such that a signal is produced to the alarm stage 21 only if the threshold of the first threshold gate 18 is exceeded and, simultaneously, the threshold of the second threshold gate 19 is not exceeded. Thus, from pairs (x, y)=(0, 0), (0, 1), (1, 0) or (1, 1) of logic values x from the threshold gate 18 and y from the threshold gate 19, the logic circuit 20 produces the respective logic values 0, 0, 1 or 0.

By suitable choice of the thresholds used by the threshold gates 18 and 19, a preferred scattered-light smoke detector of the invention has the following properties:

1. If smoke enters an uncontaminated measurement chamber, the threshold of only the first threshold gate 18 will be exceeded, and an alarm signal is produced as the threshold of the second threshold gate 19 is not exceeded.

2. In case of contamination of the measurement chamber, in the absence of smoke, the threshold of the first threshold gate 18 can be exceeded. But, as simultaneously the threshold of the second threshold gate 19 is also exceeded, the alarm stage 21 is blocked by the logic circuit 20, so that a false alarm due to contamination is prevented.

Figure 7:
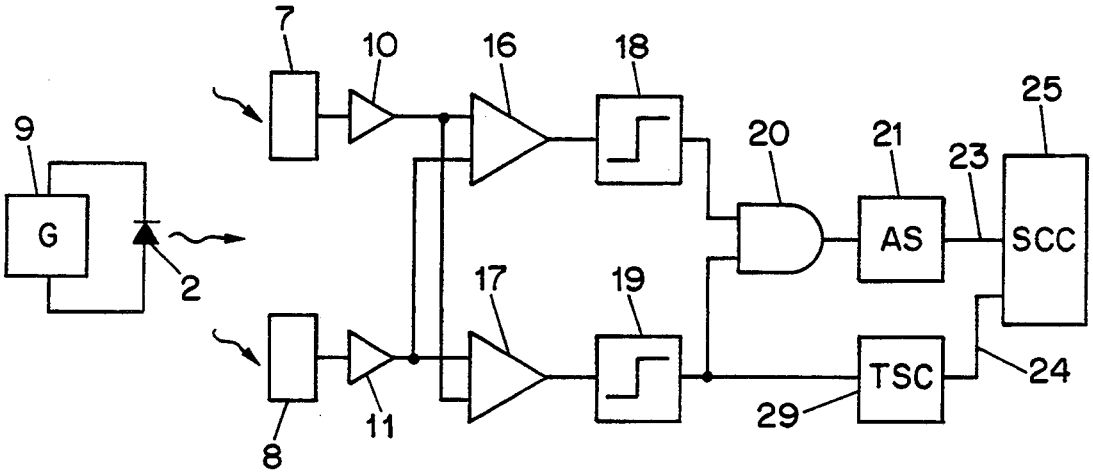
FIG. 7 is a block diagram of an alternative electronic circuit of a scattered-light smoke detector in accordance with FIG. 2.

FIG. 7 shows a further example of an electronic circuit of an optical smoke detector in accordance with the invention, in which a trouble signal is transmitted to the signalling and control center 25 in case of contamination. Here, the second threshold gate 19 is further connected to a trouble-signalling circuit 29 which produces a trouble signal when the threshold of the second gate 19 is exceeded. This signal is transmitted to the signalling and control center 25 by means of a second signalling line 24. In the signalling and control center 25, the trouble signal can be used as an indicator of smoke-detector contamination, to initiate cleaning or replacement of the detector. In other respects the circuit operates as described above for FIG. 6.

EXAMPLE 2

In the device of FIG. 4, the same advantages are realized as described in Example 1 above. Here, one radiation detector suffices; however, signals to be compared are produced sequentially and stored for later processing.

Disposed in the measurement chamber 1 are first and second radiation sources 2 and 22, a radiation detector 7, and a diaphragm system 4 preventing direct irradiation of the radiation detector 7 by radiation from the radiation sources 2 and 22. Extraneous matter F is on the surface of the measurement chamber, exemplifying a source of spurious radiation.

FIG. 8 shows an electronic circuit for the smoke detector of FIG. 4. In operation, the radiation sources 2 and 22 are periodically activated in alternating fashion by a generator 9, sending light pulses into the measurement chamber 1. The diaphragm system 4 prevents direct irradiation of the radiation detector 7. The output signal of the detector 7 is amplified by the amplifier 10 and supplied to the switch 26 which is synchronized by the generator 9, connecting in alternating fashion the first and second sample-and-hold circuits 27 and 28 with the amplifier 10. The output signals of the sample-and-hold circuits 27 and 28 correspond to the respective peak values of the output signals of the radiation detector 7. The sample-and-hold circuits 27 and 28 may simply consist of capacitors which are charged or discharged via the switch 26.

As shown in FIG. 8, the output terminals of the two sample-and-hold circuits 27 and 28 are connected to operational amplifiers 16 and 17, respectively forming the average values and the absolute values of the relative difference of the output signals of the sample-and-hold circuits 27 and 28. Further signal processing is as described above in Example 1.

A trouble-signalling circuit (not shown in FIG. 8) can be included analogous to the one described above in Example 1, for transmitting a trouble signal to the signalling and control center 25.

EXAMPLE 3

Figure 5:
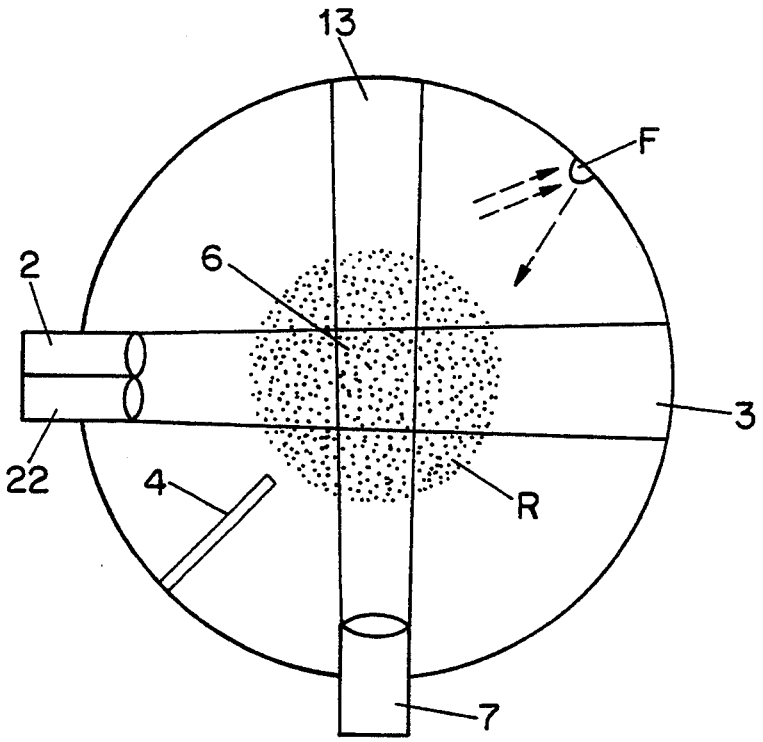
FIG. 5 is a schematic cross section of a preferred fourth embodiment of a scattered-light smoke detector in accordance with the invention, including a radiation detector and two radiation sources having different intensity distributions.

A further example of a scattered-light smoke detector is shown in FIG. 5, with prevention of false alarms due to contamination. Disposed in the measurement chamber 1 are two radiation sources 2 and 22 and a radiation detector 7. The optical beams 3 from the radiation sources 2 and 22 intersect the field of view 13 of the radiation detector 7, the intersection region serving as measurement volume. Extraneous matter F is shown on the surface of the measurement chamber, exemplifying a source of spurious radiation.

Figure 5A:
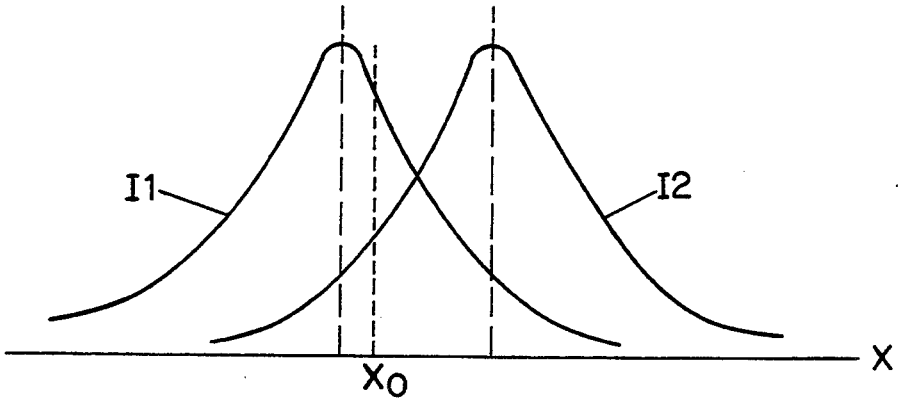
FIG. 5*a* is a graphic representation of the intensity distributions of two adjacent, overlapping radiation sources.
Figure 5B:
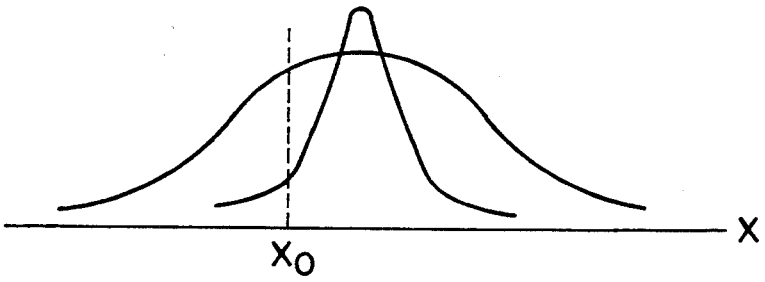
FIG. 5*b* is a graphic representation of the intensity distributions of two coaxial radiation sources having different radiation profiles.

The radiation sources 2 and 22 are spaced closely adjacent to each other, so that they have essentially the same distance from points on the surface and from points in the measurement volume. The radiation sources 2 and 22 have radiation profiles as shown in FIG. 5*a*, having the same shape but being spatially separated and overlapping. In the embodiment of FIG. 5, the optical axes of the radiation sources 2 and 22 do not coincide. In accordance with an alternative embodiment, the two radiation sources have coinciding optical axes but different radiation profiles, e.g., as shown in FIG. 5*b*.

The radiation sources 2 and 22 are periodically activated by a generator 9, sending light pulses into the measurement chamber 1. The radiation detector 7 is disposed such that the electrical signal is small under normal operating conditions without smoke or interference.

Figure 9:
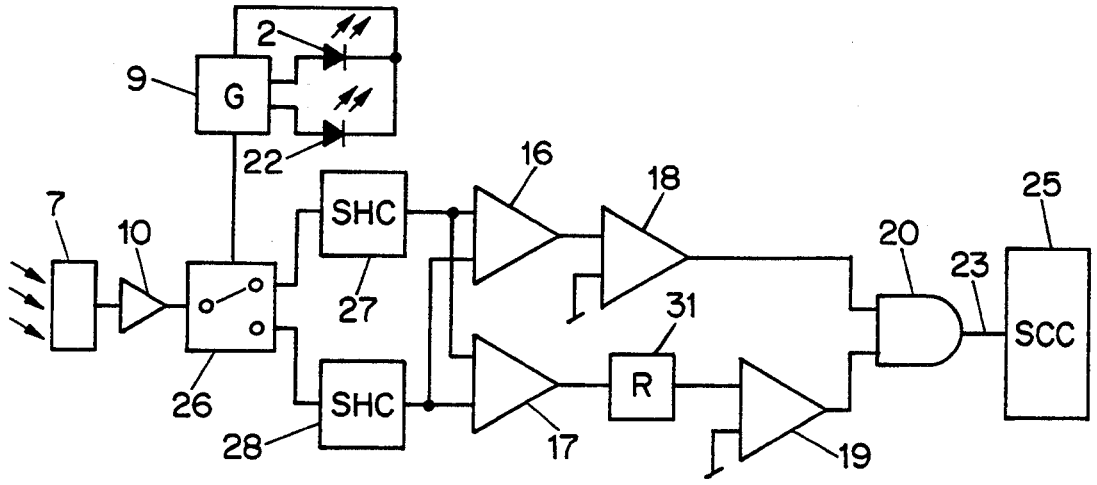
FIG. 9 is a block diagram of an exemplary electronic circuit of a scattered-light smoke detector in accordance with FIG. 5.

Electronic circuitry for a scattered-light smoke detector in accordance with FIG. 5 is shown in FIG. 9. In operation, the electrical output signal of the radiation detector 7 is amplified in a first amplifier 10 and supplied to the switch 26 which is synchronized by the generator 9, addressing in alternating fashion the sample-and-hold circuits 27 and 28. The output signals of the sample-and-hold circuits 27 and 28 correspond to the respective peak values of the output signals of the radiation detector 7. The output signals of the sample-and-hold circuits 27 and 28 are separately provided to two operational amplifiers 16 and 17.

The first operational amplifier 16 is designed such that the output signal corresponds to the average value of the sample-and-hold circuits 27 and 28. The second operational amplifier 17 is designed such that its output signal is proportional to the absolute value of the relative difference of the output signals of the sample-and-hold circuits 27 and 28. The absolute value of the relative difference is formed in the rectifier 31. This signal is a measure for the asymmetry of the scattering centers F. When smoke enters the measurement chamber 1, the output signal of the second operational amplifier 17 is small; in case of contamination, this value is large.

The output terminals of the operational amplifier 16 and the rectifier 31 are connected to respective threshold gates 18 and 19 which produce a signal if the average of the absolute value of the relative difference of the output signals of the sample-and-hold circuits 27 and 28 exceeds a predetermined threshold, as described above in Example 1.

The output terminals of the threshold gates 18 and 19 are connected to a logic circuit 20 which is designed such that a signal is produced if and only if the threshold of the first threshold gate 18 is exceeded and, simultaneously, the threshold of the second threshold gate 19 is not exceeded. Here, too, the thresholds of the threshold gates 18 and 19 can be chosen such that the properties mentioned in Example 1 are realized.

Figure 10:
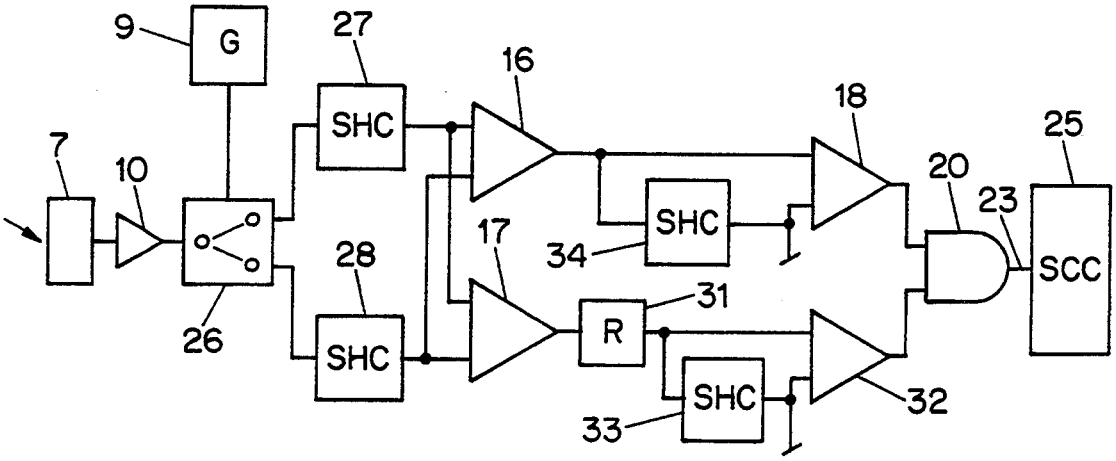
FIG. 10 is a block diagram of an alternative electronic circuit of a scattered-light smoke detector in accordance with FIG. 5.

A further example of an electronic circuit of a scattered-light smoke detector in accordance with the invention is shown in FIG. 10, also having the two properties mentioned in Example 1, and furthermore having the capability of providing a smoke alarm signal even under conditions of detector contamination or condensation, i.e., even when a trouble signal has been given.

In contradistinction to the circuit of FIG. 9, the threshold in the comparator 32, included instead of the second threshold gate 19, keeps getting reset as the penultimate output value of the rectifier 31. To this end, the most recent output values are stored in third and fourth sample-and-hold circuits 33 and 34.

In case of dust or fibers entering the scattered-light smoke detector, the output of the logic circuit 20 is zero, and no alarm signal will be transmitted. If smoke enters the contaminated detector, the relative difference between the output signals of the operational amplifiers 16 and 17 decreases. The alarm stage 20 can be unblocked when the output signal of the rectifier 31 falls below the threshold of the comparator 32. This requires adaptation of the threshold of the comparator 32 to the degree of contamination of the detector, to enable detection of smoke even under conditions of contamination. The alarm signal is transmitted to a signalling and control center 25 via a first signalling line 23.

Figure 11:
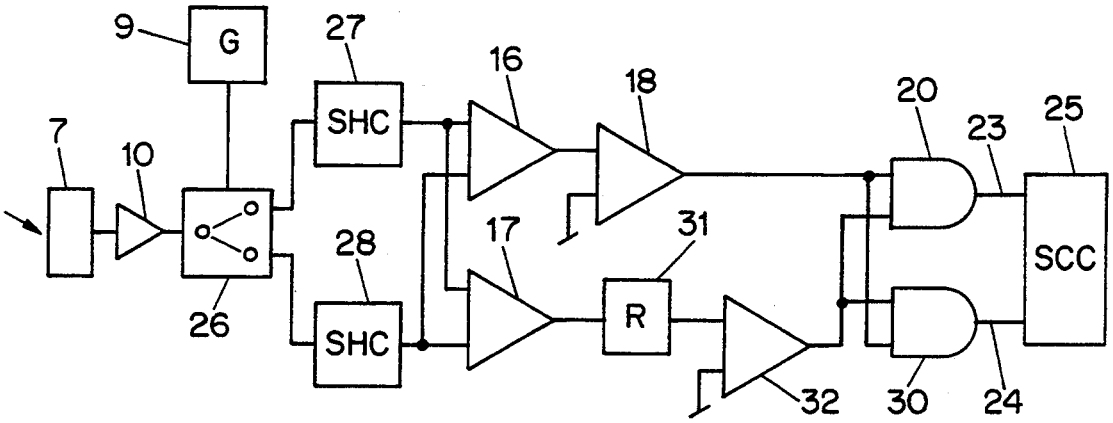
FIG. 11 is a block diagram of a further alternative electronic circuit of a scattered-light smoke detector in accordance with FIG. 5.

FIG. 11 shows a further example of an electronic circuit of a scattered-light smoke detector, additionally providing For transmission of a trouble signal to the signalling and control center 25 in case of contamination. Here, the comparator 32 is further connected to a second logic circuit 30 for producing a trouble signal when the threshold of the comparator 32 is exceeded. This signal can be transmitted via a second signalling line 24 to the signalling and control center 25. In other respects the circuit functions like the circuit of FIG. 9. In the signalling and control center 25, the trouble signal can be used as an indication of detector contamination and to initiate cleaning or replacement.

Modifications of the described circuits for fire alarm devices within the scope of the invention will be apparent to persons skilled in the art.

We claim:

1. A smoke detector comprising:

a measurement chamber with ambient-atmospheric access;

source means disposed in the measurement chamber for emitting first electromagnetic radiation;

detector means disposed in the measurement chamber for detecting second electromagnetic radiation comprising radiation due to scattering of first electromagnetic radiation by smoke particles in a measurement volume in the measurement chamber; and evaluation-and-signalling means (FIGS. 6–11) connected to the detector means (i) for generating an alarm signal upon detection of second electromagnetic radiation having at least a first portion produced essentially homogeneously in the measurement volume, and (ii) for generating a trouble signal upon detection of second electromagnetic radiation having at least a second portion produced with significant nonhomogeneity in the measurement chamber.

2. The smoke detector (FIGS. 2, 3) of claim 1, wherein:

the detector means comprises first and second detectors; and the evaluation-and-signalling means (FIGS. 6, 7) comprises logic-circuit means for comparing signals which are derived, respectively, from output signals from the first and second detectors.

3. The smoke detector (FIGS. 4, 5) of claim 1, wherein:

the source means comprises first and second sources;

the evaluation-and-signalling means (FIGS. 8, 9) comprises generator means for alternatively activating the first or the second source, and respective first and second sample-and-hold means for alternatively storing output signals of the detector means in synchrony with the activation of the first or the second source.

4. The smoke detector (FIG. 5) of claim 3, wherein the first and second sources have first and second radiation fields with essentially the same intensity profile (FIG. 5*a*), and are disposed such that the first and second radiation fields overlap at least in part.

5. The smoke detector (FIG. 4) of claim 3, wherein the first and second sources have first and second radiation fields with different intensity profiles (FIG. 5*b*), and are disposed with substantially coaxial radiation-emission axes.

6. The smoke detector of claims 2, 3, 4 or 5, wherein the evaluation-and-signalling means comprises:

first operational amplifier means for producing a first value representing the average value of first and second detector output values;

second operational amplifier means for producing a second value representing the absolute value of the relative difference between first and second detector output values;

first threshold gate means connected to the first operational amplifier means for setting a first logic signal if and only if the first value exceeds a predetermined first threshold;

second threshold gate means connected to the second operational amplifier means for setting a second logic signal if and only if the second value exceeds a predetermined second threshold;

logic circuit means connected to the first and second threshold gate means for producing an alarm signal if and only if the first logic signal is set and the second logic signal is not set.

7. The smoke detector of claim 6, wherein the evaluation-and-signalling means comprises trouble-signalling means for transmitting a trouble signal if and only if the second logic signal is set.

8. The smoke detector of claim 6, wherein the evaluation-and-signalling means comprises update means for repeatedly updating a threshold value.

9. The smoke detector of claim 1, further comprising optical means for imaging the measurement volume onto the detector means, the detector means being divided into a plurality of detector portions.

10. The smoke detector of claim 9, wherein the detector means is divided into four detector portions.

11. The smoke detector (FIGS. 2, 3) of claim 1, wherein the detector means comprises first and second radiation detectors, and wherein the evaluation-and-signalling means is connected to the first and second radiation detectors (i) for generating, upon activation of the source means, the alarm signal upon simultaneously receiving signals from the first and second radiation detectors which are substantially equal, and (ii) for generating, upon activation of the source means, the trouble signal upon simultaneously receiving signals from the first and second radiation detectors which are significantly different.

12. The smoke detector (FIGS. 4, 5) of claim 1, wherein the source means comprises first and second radiation sources, and wherein the evaluation-and-signalling means is connected to the detector means (i) for generating, upon sequential activation of the first and second sources, the alarm signal upon sequentially receiving from the detector means substantially equal signals upon activation of the first source as upon activation of the second source, and (ii) for generating, upon sequential activation of the first and second sources, the trouble signal upon sequentially receiving from the detector means significantly different signals upon activation of the first source as upon activation of the second source.

* * * * *